United States Patent [19]

Zufich

[11] 4,154,381

[45] May 15, 1979

[54] BACKPACK AND FRAME APPARATUS

[76] Inventor: Anthony C. Zufich, P.O. Box 333, Bodfish, Calif. 93205

[21] Appl. No.: 863,663

[22] Filed: Dec. 23, 1977

Related U.S. Application Data

[63] Continuation-in-part of Ser. No. 690,068, May 26, 1976, Pat. No. 4,099,657.

[51] Int. Cl.[2] ..... A45F 3/10

[52] U.S. Cl. ..... 224/262; 280/1.5

[58] Field of Search ..... 224/8 R, 25 A, 8 A, 224/9, 10, 11, 12, 25 R; 280/1.5

[56] References Cited

U.S. PATENT DOCUMENTS

| | | | |
|---|---|---|---|
| 3,355,075 | 11/1967 | Dean | 224/25 A |
| 3,797,718 | 3/1974 | Plant | 224/25 A |
| 3,827,612 | 8/1974 | Mead et al. | 224/25 A |
| 3,840,162 | 10/1974 | Horenstein et al. | 224/25 A |
| 4,015,759 | 4/1977 | Dreissigacker | 224/8 R X |

*Primary Examiner*—Robert J. Spar
*Assistant Examiner*—Jerold M. Forsberg

[57] ABSTRACT

A backpack and frame apparatus comprising a pair of tubular side bars and lateral cross-members for supporting a backpack and upper terminus of the shoulder harness. A supporting belt adapted to be coupled about the user's waist and hips includes downwardly projecting panels disposed on diametrically opposed sides of the belt and adapted to lie substantially below the waist of the user. A pair of lever arms are pivotally coupled at the lower end of each of the tubular side bars, the two lever arms being coupled to one another to provide for reciprocal movement of the arms about the pivotal coupling to the lower side bars. Each of the lever arms is secured to one of the downwardly projecting panels respectively to provide independence between the pack frame and the movement of the user.

6 Claims, 5 Drawing Figures

Fig. 1.
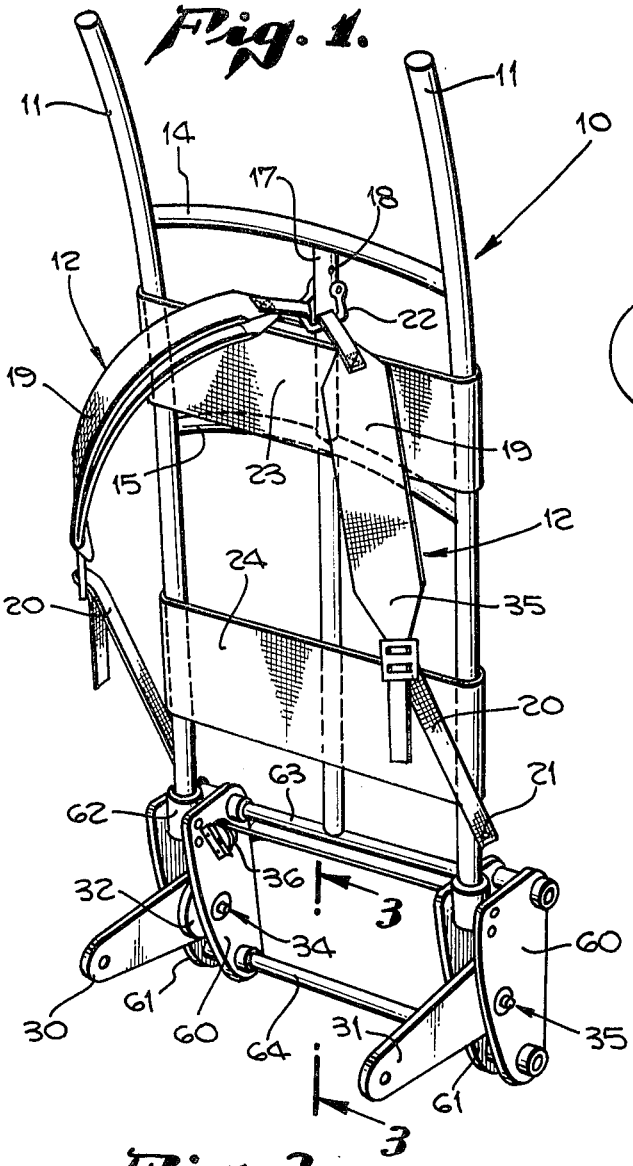
Fig. 3.
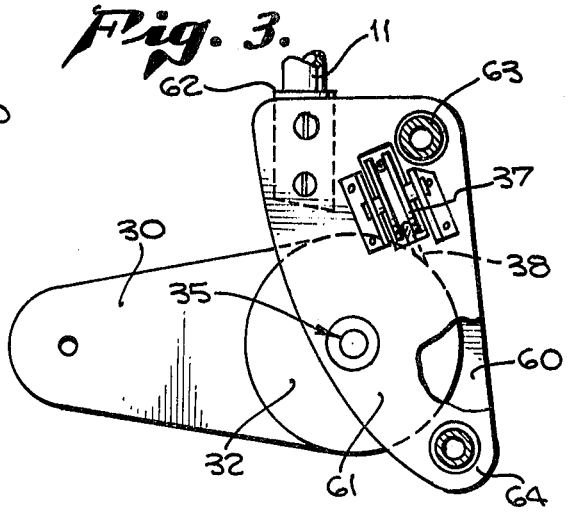
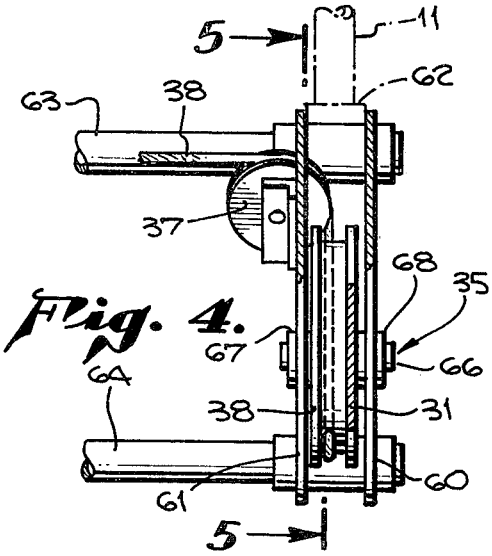
Fig. 4.
Fig. 2.
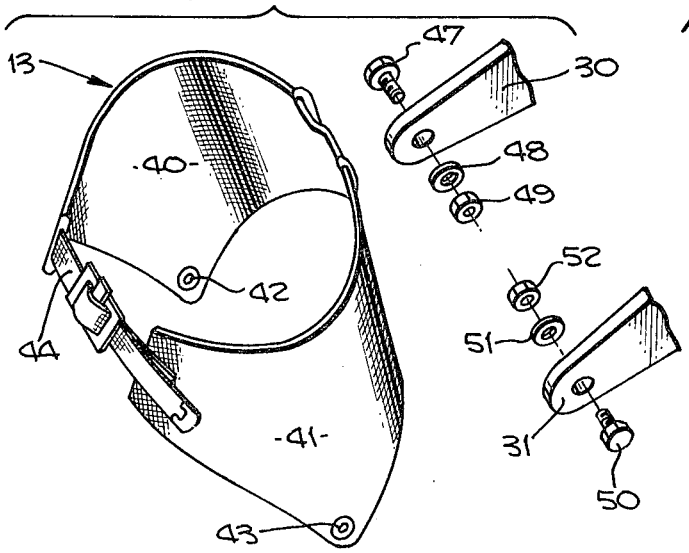
Fig. 5.
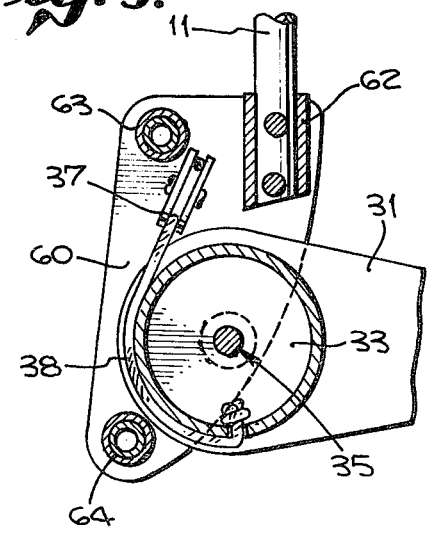

BACKPACK AND FRAME APPARATUS

This is a continuation-in-part of my co-pending Application Ser. No. 690,068, filed May 26, 1976, now U.S. Pat. No. 4,099,657.

BACKGROUND OF THE INVENTION

1. Field of the Invention

The present invention generally relates to a pack frame and sack which is adapted to be utilized by campers, hunters, fishermen, climbers and the like and, more particularly, to those backpacks which utilize the hips of the user to support the load.

2. Prior Art

There are numerous pieces of prior art which disclose backpacks, pack frames and related apparatus. One of the most pertinent pieces of prior art discloses a pack frame and sack therefor which has a primary object to provide a pack frame by which a major portion of the load is carried by the hips of the user. In this device, the hip strap is padded and is tightened about the hips of the user in a position which is intended to engage the hip bones. The load carried by the sack is transferred to the hip strap at each side rather than primarily to the back or shoulders of the user. In this device, an L-shaped hip tube having an upright post and a forward extending arm is mounted adjacent the lower end of side bars and extends forwardly along the hip of the user. A joint for connecting each hip tube and the side bars is adjustable upwardly and downwardly along the side bar while a series of differently angled holes in the post of the hip tube permits the angle of the hip tube to be varied through the use of a removeable pin. The hip strap includes an outer strap and inner padding and is tightened about the hips of the user while a pin carried in each side of the hip strap extends through a grommet at the lower end of the corresponding shoulder strap and through the corresponding hip tube so that the weight of the pack is concentrated at the sides of the hips of the user rather than on the shoulder. The inadequacies of this device are obvious. Since the hip tubes are attached rigidly to the frame of the pack on one end, and to a single point on the belt at the other, that weight of the pack which is not being carried by the shoulders is brought to bear on a small area over each hip. Since the hips rise and fall in walking, friction occurs between the belt and the hip.

Another backpack and frame disclosed by the prior art utilizes a hip belt which is disposed about the waist of the wearer. The pack frame has two substantially vertical side bars and remaining sections of tubing and tees which form the side and transverse connectors of the frame. At least some of the joints of the tubing sections and tees are detachable so that the frame may be disassembled. The hip belt is disposed about the waist of the wearer and holds the bottom of the frame in a vertical position. The problem which arises by use of this device is apparent in its design. An attempt is made to support the load about the waist of the user, but there is no provision for support and independence between the load and the user.

Another pack frame and assembly which is disclosed by the prior art is adapted to be carried upon a person's back through the use of shoulder straps and having hip-engaging means thereon to bear on a portion of a person's hips so as to carry the majority of the load thereagainst. The hip-engaging means includes a backplate assembly having a pair of anchor plates connected to respective ones of the support tube members which constitute the primary vertical support of the pack. The belt assembly is adapted to be placed about the waist of the user above the hip line, the full weight of the pack frame being centered at the waist of the user on opposite sides thereof as well as the user's shoulders. As with the devices described hereinabove, the inability to provide independence of movement between the user and the load renders the prior design inadequate.

The present invention substantially resolves the problem which are inherent in the devices disclosed by the prior art. A contoured belt is adapted to be disposed about the waist of the user, the belt including downwardly extending load support panels which are adapted to be coupled to the load at a point which is substantially below the waist. A pair of lever arms are each pivotally coupled to the bottom section of one of the pack frame side members, the lever arms being parallel to one another. The lever arms are coupled to one another whereby movement of one lever arm about its pivotal coupling will permit an equal and opposite movement of the second lever arm about its pivotal coupling. The lever arms are respectively secured to the downwardly extending load support panel. The pack frame is substantially isolated from the movement of the lever arms. In this manner, the user will be permitted to have normal rotational hip action without being retarded by the load supported on the pack frame. The support of the load is at a point substantially below the waist of the user which provides for better distribution of the load to the hips, the non-rigid coupling between the lever arm and the frame providing for independence of movement between the user and the load.

SUMMARY OF THE INVENTION

The present invention comprises a backpack and frame assembly which substantially improves the ability to carry a load thereon. A pair of side frame members are used to construct the basic structure of the pack, the side frame members are in spaced relation parallel to each other and are adapted to be substantially vertical to the ground when the pack frame is mounted upon a user. A pair of lever arms are pivotally coupled to the lower extension of the side frame members. The lever arms are identical and are adapted to pivot in planes which are parallel to each other. A pulley having a cylindrical circumference is secured to each lever arm about the pivotal coupling between the lever arm and the side frame member. A non-resilient coupling is secured between the pulley surfaces of each lever arm in a manner which will cause each lever arm to adjustably react to movement by the other as a result of their coupling to the user.

A supporting belt is disposed about the waist of the user, the belt having downwardly extending panels or gussets along the hips of the user. The downwardly extending supporting panels each include appropriate couplings which are disposed substantially below the waistline of the user. The couplings lie on opposite sides of the user and are in substantially the same plane. The ends of the lever arms opposite the pivotal couplings are secured to the downwardly extending support panels. Joining the lever arms and the pack frame to the supporting belt allows for attachment at a point which is substantially below the waistline of the user. The full load which is being supported by the pack frame will be distributed along the hips of the user in a manner which cannot be obtained if the load is attached directly to the belt. The reciprocal coupling intermediate the lever arm and the pack frame will permit the lever arms to reciprocally pivot as a result of the hip movement of the user in a manner which will be independent from the pack frame. When the user moves in a normal manner his hips will tend to rise and fall and thereby transfer equal motion to the pivot or lever arm. The pack frame is held in place by shoulder straps and therefore can be maintained in a stable position irrespective of the rocking movement which is transferred to the lever arm by the ambulatory motion of the user.

It is therefore an object of the present invention to provide an improved backpack and frame apparatus.

It is another object of the present invention to provide a backpack and frame apparatus which isolates the user's movement from the supported load.

It is still another object of the present invention to provide a backpack and frame apparatus which fully distributes the supported load about the hips of the user.

It is still yet another object of the present invention to provide a backpack and frame apparatus which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

BRIEF DESCRIPTION OF THE DRAWING

FIG. 1 is a front perspective view of a backpack and frame apparatus in accordance with the present invention.

FIG. 2 is an assembly view of the coupling between the lever arms shown in FIG. 1 and the supporting belts used in connection with the present invention.

FIG. 3 is a partial, cross-sectional view of the lever arm and coupling shown in FIG. 1 taken through line 3—3 of FIG. 1.

FIG. 4 is a front elevation view of the lever arm and pulley connection of the present invention backpack and frame apparatus.

FIG. 5 is a cross-sectional view of the pulley-lever arm assembly shown in FIG. 4 taken through line 5—5 of FIG. 4.

DESCRIPTION OF THE PRESENTLY PREFERRED EMBODIMENT

Referring now to FIG. 1, an understanding of the basic structure of the present invention backpack and frame apparatus can be best seen. Backpack and frame assembly 10 comprises a pair of pack frame side members 11 which are laterally coupled in a manner which will be described hereinbelow. Frame side members 11 are substantially parallel to each other and are adapted to be in a substantially vertical position when frame assembly 10 is mounted upon a user. Shoulder straps 12 are secured to backpack and frame assembly 10 to provide upward support for the load which is carried upon the rear of frame assembly 10. The user has disposed about his waist a supporting belt 13 which can be best seen in FIG. 2. Supporting belt 13 has disposed along each side thereof downwardly extending support sections or gussets which extend substantially below the waistline of the user. The manner in which supporting belt 13 is joined to backpack and frame assembly 10 will be described in detail hereinbelow.

Backpack and frame assembly 10 comprises a pair of frame side members 12 which are disposed in parallel spaced relation to each other. Lateral cross-members 14 and 15 are coupled intermediate frame side members 11 in a manner which will maintain the rigidity of frame 10 and maintain the appropriate spaces between frame side members 11. Although any conventional coupling can be utilized, lateral cross-members 14 and 15 are typically welded to frame side members 11 if appropriate materials are used. Where it is desired to produce a form of the present invention which is lightweight, frame side members 11 and the lateral cross-members 14 and 15 are preferably formed of lightweight tubing such as magnesium or aluminum. Where the elements of frame assembly 10 are fabricated of materials which cannot be welded, appropriate mechanical couplings can be substituted therefor.

Shoulder strap support tube 17 is coupled intermediate cross-members 14 and 15, extension 16 thereof extended down the full length of frame assembly 10 and being coupled to lateral separator 63. Support tube 17 includes an aligned vertical adjustment apertures 18 in spaced relation to one another. Shoulder straps 12 include a padded section 19 which is adapted to be disclosed about the shoulders of the user, padded sections 19 being coupled to the lower portions of frame side members 11 through use of adjustable straps 20. Straps 20 are joined to frame side members 11 by grommets and clevis pins or any other conventional mechanical coupling means 21 at a position which will lie substantially adjacent the waist of the user. The termini of padded sections 19 opposite to strap 20 are secured by a substantially U-shaped bracket 22 which is in turn attached to shoulder straps support tubes 17 by means of a clevis pin that passes through one of the adjustment apertures 18 to conform to the size of the user. In order to provide for comfort, webbing 23 and 24 and be laterally disposed between frame side members 11 to cushion the load against the back of the user and provide an air space between the user and the load being supported. Additional comfort may be created by altering the curvature of the lateral cross-member 17 to account for the typical curvature which would occur at the mid-section of the back of a user.

As stated hereinabove, an object of the present invention is to provide for substantial isolation between the load being supported by pack frame 10 and the user. Lever arms 30 and 31 are pivotally coupled at the lower termini of each of the frame side members 11. The lever arms 30 and 31 include concentric pulley 32 and 33 respectively which are concentric with the pivotal couplings 34 and 35 about which lever arms 30 and 31 rotate. As will be described in detail hereinbelow, a non-resilient coupling such as nylon line is disposed intermediate pulleys 32 and 33, pulleys 36 and 37 being perpendicular to lever arms 30 and 31 and the appropriate directional changes from pulleys 33 and 34 respectively. It is understood that the term non-resilient coupling refers to members which have only a nominal degree of elasticity. The non-resilient coupling 38 couples the movement of lever arms 30 and 31 whereby the net force applied to any lever arm will cause equal and opposite reaction at the other lever arm.

Primary support for the present invention backpack and frame assembly 10 is derived from support belt 13 which can be best seen in FIG. 2. Support belt 13 includes a pair of complementary sections disposed at either side of the user and are adapted to lie along the hips of the user. Support belt 13 is prefarably fabricated from an interlaced meshed structure although padding, foam, leather or other typical construction materials can be used. The use of a mesh structure will combine the necessary strength with means for cooling the areas of the user which are covered by belts 13. Supporting belt 13 comprises downwardly extending panels 40 and 41 which constitute gussets which will extend below the waist of the user along his hips. The apex of each gusset 40 and 41 includes apertures 42 and 43 respectively which are complementary to one another. The tapered profile of gussets 40 and 41 provide the means for distributing any load thereon substantially about the periphery of supporting belt 13. Strap 44 is used to secure belt 13 about the waist of the user. The significance of the load distribution will be explained in detail hereinbelow. Supporting belt 13 is coupled to the remaining portion of frame assembly 10 through the use of lever arms 30 and 31. Lever arms 30 and 31 include apertures 45 and 46 respectively. As can be seen in FIG. 2, apertures 42 and 45 are aligned with one another and secured to one another by a conventional coupling which can typically comprise bolts 47, washer 48 and nut 49. In a like manner, apertures 43 and 46 are aligned and joined by the conventional coupling typically comprising bolt 50, washer 51 and nut 52. The couplings between lever arms 30 and 31 and gussets 40 and 41 must be secure while simultaneously permitting relative movement therebetween. In order to provide this requirments, nylon bushings can be inserted intermediate the lever arm and the gussets.

As stated, a primary objective of the present invention is to isolate the load being supported by backpack and frame assembly 10 from support point of the user. In this case, it is the intent to support primarily the entire load along the hips of the user through the mechanical coupling of lever arms 30 and 31 to supporting belt 13. In order to provide for appropriate isolation, the ambulatory movement of the user must not be transmitted through to frame assembly 10. Referring now to FIGS. 3, 4 and 5, the structure for isolating the load from the user can be best seen. The lower terminus of frame side members 11 is coupled intermediate framing brackets 60 and 61. Collar 62 is securely affixed intermediate framing brackets 60 and 61, the lower terminus of side frame member 11 being disposed therein. Separators 63 and 64 are coupled intermediate frame brackets 60 and 61 to maintain the parallel spaced relationship of framing brackets 60 and 61 thereby permitting free movement of lever arms 30 and 31.

Lever arm 30 comprises a circular pulley 65 which rotates about pivot coupling 34. As can be best seen in FIG. 4, pulley 65 has disposed therebetween shaft 66 whch is in abuttment with bushings 67 and 68 which will facilitate the rotation thereof. Caps 67 and 68 are typically fabricated of nylon, polyvinyl chloride or other materials which will reduce the friction between shaft 66 and the enclosing structure 67 and 68. Pulley 32 is secured affixed to lever arm 30, the composite structure rotating about pivoted coupling 34. In a like manner, pulley 33 is secured to lever arm 31 and the composite structure rotating about pivoted coupling 35. Cord 38 is wrapped around pulleys 32 and 33, an end thereof being disposed through an aperture in the peripheral surface of pulleys 32 and 33, the cord being secured within the interior cavity thereof. As can be best seen in FIG. 5, cord 38 is stretched from the peripheral surface of pulley 33 and over a second pulley 37. Although not fully shown, cord 38 is disposed over secondary pulley 36 and wrapped about the peripheral surface of pulley 32 in the identical manner shown in FIG. 5. Referring again to FIG. 1, the interconnection between lever arms 30 and 31 will cause both pulleys 32 and 33 to react to the net force which is applied. When lever arms 30 and 31 are secured to support belt 13, the rocking motion which will inherently occur from the ambulatory movement of the user's hips will be transferred through the lever arm as a result of cord 38. As an example, the upward movement of lever arm 30 will cause an equal but opposite downward rotation of lever arm 31 thereby maintaining total stability of frame 10 and any load carried thereon. As stated previously, an objective of the present invention is to provide full ambulatory movement on the part of the user independent of the load being supported by frame 10. As can be seen, the load being supported by frame 10 is transmitted through collar 62 to lever arms 30 and 31. By coupling lever arms 30 and 31 to supporting belt 13 substantially the entire load being supported by frame 10 will be supported about the hips of the user. The reciprocating movement created by the coupling of pulleys 32 and 33 allows the hips of the user, and therefore supporting belts 13, to rotate in a normal manner without transmitting such movement to the load supported by frame 10. Since no movement of the user's hips will be transmitted to the load, normal ambulatory movement will be enhanced.

It can therefore be seen that the present invention provides a substantial improvement over the backpack assemblies which are disclosed by the prior art. By providing means to suspend the loads of the backpack from a point substantially below the waist of the user, and by distributing that load in a efficient manner below the waist of the user, any discomfort which would normally occur is substantially eliminated. In addition, by providing independence of movement between the backpack frame and the user, the load does not act in any manner to retard the free movement of the user while simultaneously permitting the load to be supported in a comfortable manner.

I claim:

1. A backpack frame apparatus comprising:

(a) a frame including a pair of side bar members and upper and lower lateral cross-members connecting said side bar members;

(b) an upper support tube coupled intermediate a pair of upper cross-members intermediate said side bar members;

(c) a pair of shoulder straps, the upper ends thereof attached to said support tube;

(d) hip belt means for encircling the waist of a user, said hip belt means including downwardly extending panels adapted to lie along the hips of the user;

(e) means for attaching the lower ends of said shoulder straps to respective ones of said side bar members substantially adjacent the waist of the user;

(f) first and second lever arms in parallel spaced relation to one another, each being rotatably coupled to a side bar member, each of said first and second lever arms being coupled substantially intermediate one of said side bar members and a respective one of said downwardly extending panels; and (g) means for reciprocally coupling said first and second lever arms to one another independent of said hip belt means whereby each of said lever arms is responsive in an opposite direction to the movement of the other about its rotatable coupling to said side bar member.

2. A backpack frame apparatus as defined in claim 1 wherein said means for reciprocally coupling said first and second lever arms comprises:

(a) first and second cylindrical pulleys secured at a first end of said first and second lever arms respectively, said joined pulleys and lever arms being rotatable about an axis centered at the axis of said pulleys;

(b) a pair of framing brackets secured to each of said side bar members and in parallel spaced relation to each other;

(c) shafts secured to each of said first and second pulleys along the axis thereof, one of said shafts being rotatably mounted between each respective pair of framing brackets;

(d) means for coupling the second end of each of said first and second lever arms to said downwardly extending panel;

(e) third and fourth pulleys each coupled to a respective pair of framing brackets, said third and fourth pulleys being perpendicular to the plane of each of said first and second pulleys respectively; and (f) non-resilient means for coupling said first and second pulleys, said non-resilient means being secured intermediate said first and second pulleys and being in engagement with said third and fourth pulleys.

3. A backpack frame apparatus as defined in claim 2 wherein said non-resilient means comprises a line having first and second ends, the first end being affixed to said pulley and being deflected across said third pulley at a tangent to said first pulley, the second end of said cable being affixed to said second pulley and being deflected across said fourth pulley at a tangent to said second pulley.

4. A backpack frame apparatus comprising:

(a) a frame comprising a pair of side bar members and upper and lower lateral cross-members connecting said side bar members in parallel spaced relation to one another;

(b) an upper support tube coupled intermediate a pair of upper cross-members, said upper support tube having vertically oriented adjustment apertures in spaced relation to each other and aligned parallel to said side bar members;

(c) a pair of shoulder straps, the upper ends thereof being coupled to vertically aligned adjustment apertures;

(d) a hip belt including an engagement member adapted to encircle the waist of a user, said hip belt including a pair of downwardly extending gussets the lower projection of said gussets being substantially below said engagement member and adapted to be adjacent the hips of the user;

(e) means for attaching the lower ends of said shoulder straps to respective ones of said side bar members substantially adjacent said lower lateral cross-members;

(f) first and second lever arms in parallel spaced relation to each other;

(g) first and second cylindrical pulleys secured at a first end of said first and second lever arm respectively, said joined pulleys and lever arms rotatable about an axis centered at the axis of said pulleys;

(h) a pair of framing brackets secured to each of said side bar members and in parallel spaced relation to each other;

(i) shafts secured to each of said first and second pulleys along the axis thereof, one of said shafts being rotatably mounted between respective pairs of said framing brackets;

(j) means for coupling the second ends of each of said first and second lever arms to said downwardly extending gussets; and (k) means for coupling said first and second pulleys to one another whereby each of said first and second lever arms is responsive to the movement of the other about said shafts.

5. A backpack frame apparatus as defined in claim 4 wherein said means for coupling said first and second lever arms comprises:

(a) third and fourth pulleys each coupled to a respective pair of framing brackets, said third and fourth pulleys being perpendicular to the plane of said first and second pulleys respectively; and (b) non-resilient means for coupling said first and second pulleys, said non-resilient means being secured intermediate said first and second pulleys and being in engagement with said third and fourth pulleys.

6. A backpack frame apparatus as defined in claim 5 wherein said non-resilient means comprises a cable having first and second ends, the first end being affixed to said first pulley and being deflected thereabout and being in engagement with said third pulley at a tangent to said first pulley, the second end of said cable being deflected about said second pulley and being in engagement with said fourth pulley at a tangent to said second pulley.

* * * * *